US006405858B1

(12) United States Patent
Gagliardi

(10) Patent No.: US 6,405,858 B1
(45) Date of Patent: Jun. 18, 2002

(54) JEWELRY ENHANCING LIGHTING DEVICE AND PROCESS

(76) Inventor: Frank S. Gagliardi, 8716 N. Thunderbird Rd., Maricopa, AZ (US) 85239

( * ) Notice: Subject to any disclaimer, the term of this patent is extended or adjusted under 35 U.S.C. 154(b) by 0 days.

(21) Appl. No.: 08/825,687

(22) Filed: Apr. 2, 1997

(51) Int. Cl.[7] ..... A45C 11/04; G10F 1/06; F21V 33/00

(52) U.S. Cl. ..... 206/6.1; 84/94.2; 206/566; 362/155; 362/156

(58) Field of Search ..... 84/94.2, 95.2; 362/86, 154, 155, 156; 206/6.1, 566

(56) References Cited

U.S. PATENT DOCUMENTS

| | | | | | |
|---|---|---|---|---|---|
| 1,746,810 | A | * | 2/1930 | Anderson | 362/155 |
| 2,572,095 | A | * | 10/1951 | Baillie | 362/155 |
| 4,914,545 | A | * | 4/1990 | Price | 362/155 |
| 4,917,459 | A | * | 4/1990 | Solitt et al. | 706/566 X |
| 4,992,912 | A | * | 2/1991 | Lee | 362/86 |

FOREIGN PATENT DOCUMENTS

| | | | | |
|---|---|---|---|---|
| CH | 666609 | * | 8/1988 | 206/566 |
| DE | 236010 | * | 5/1986 | 206/566 |
| GB | 515852 | * | 12/1939 | 84/95.2 |

* cited by examiner

*Primary Examiner*—Bryon P. Gehman
(74) *Attorney, Agent, or Firm*—Ellis Venable & Busam L.L.P.

(57) ABSTRACT

A display box for aesthetically presenting jewelry is provided. The display box of the present invention includes provisions for under lighting the displayed jewelry when the display box is opened. Additionally, the display box of the present invention may include a sound source or voice recordable chip connected in series with the light source, thus providing visual and aural enhancement of the displayed jewelry. The display box of the present invention may additionally be adapted to hold, display and illuminate more than one piece of jewelry.

20 Claims, 8 Drawing Sheets

PRIOR ART

JEWELRY ENHANCING LIGHTING DEVICE AND PROCESS

The present invention relates generally to jewelry and more particularly concerns jewelry display boxes wherein unique electrical lighting and sound features enhance the display box's utility. The invention will be specifically disclosed in connection with a jewelry display box which, when opened, under lights the displayed piece of jewelry. Additionally, the jewelry display box may include sound emitting devices which provide pleasing music and/or messages. These display boxes provide a more aesthetically pleasing manner in which to display jewelry.

BACKGROUND

Jewelry has become an important part of the world economy. A significant fraction of a person's disposable income may be devoted to the purchase of jewelry to display affection, devotion or gratitude to another. As a result of this purchasing power and activity, a highly competitive jewelry market has evolved. Since every jeweler provides similar jewelry, a jeweler who provides his or her goods in the most aesthetically appealing manner, will increase the likelihood of obtaining a larger market share. Furthermore, a jeweler who provides additional services and benefits to his or her clients will gain even more customers.

There are many jewelry display devices which are designed for use only by a professional jeweler, or for the display of a wide variety of ornamental items. For the most part, these display devices contain multiple displayed jewelry items and are placed within a display case with an interior light source.

There are also jewelry display boxes which are contain a single piece of jewelry. When a consumer purchases the displayed jewelry, the jeweler includes the display box as a container. These display boxes are typically staid and ordinary and do not, by themselves, enhance the display of the jewelry.

PRIOR ART

Jewelry display boxes are well know in the prior art. Personal, or single item jewelry boxes are typically of two piece construction, a top section attached to a bottom section by a hinge. These jewelry boxes have an external felt covering making them pleasing to the touch. Included inside of the top section is a fabric liner that is silky to the touch. Included inside of the bottom portion is a display insert, or faux bottom, that is also frequently covered with felt and is used to securely hold and display the article of jewelry.

The patent literature is replete with basic refinements upon the above, illustrated by the following patents. Some refinements are directed toward the basic structure of the jewelry display box. In U.S. Pat. No. 1,681,755, Warner et al. teaches a jewelry box that includes a spring biased ring holder. The spring biasing of the ring holder allows a variety of differently sized rings to be placed within the display device without irreversibly deforming the ring holder. In U.S. Pat. No. 1,906,822, Shields teaches a novel design for jewelry boxes that incorporates a flanged, enlarged rim section that provides a neat looking finish and is useful for securely holding the jewelry box liner.

Some refinements to single article jewelry boxes include elements that allow the placement and position of displayed jewelry to change. In U.S. Pat. No. 1,980,776, Warner teaches a novel design for jewelry boxes that incorporates a rotatable ring holder. Rotation of the ring holder along a horizontal axis normal to the direction of viewing allows one to alter the angle at which a ring is presented in order to display the ring in a most flattering light. In U.S. Pat. No. 2,864,497, Sofo teaches a novel design for jewelry boxes that incorporates a display of at least one ring rotatable along an axis perpendicular to the display insert. In U.S. Pat. No. 4,101,023, Schuander teaches a design for jewelry boxes that incorporates a removable display stand nested within the jewelry box. The display stand has a sign holder attached thereon, and may be removed from the box. The display stand may then be placed separate from the jewelry box to display jewelry. These patents disclose passive features, such as placement, that may be added to jewelry boxes to display items in a more flattering manner.

The above patents to not provide for a jewelry display box with features that actively enhance the displayed jewelry. One form of active enhancement contained in a jewelry display box is illumination. U.S. Pat. No. 712,112 by Arnold teaches a pocket watch display box that illuminates the pocket watch when the lid is opened. In this patent, an interruptible circuit is formed by a latch-spring lock mechanism. When the display lid is closed, a latch is held away from a contact portion thus preventing completion of the circuit. Upon opening the lid, the latch, which is spring biased, is forced onto the contact portion, thus completing the circuit and lighting a lamp located in a lid attached to the pocket watch display box. This remote light illuminates the entire box, and consequently, the pocket watch. Furthermore, the power source for the lamp is located in the bottom of the display box, while the lamp is located in the lid. Constant opening of the box will flex the electrically conductive wires connecting the power source to the lamp, thereby work hardening the wire and leading to stress failure.

U.S. Pat. No. 1,900,467 by Scruggs teaches a non-portable jewelry display designed for the display of numerous rings simultaneously. This display consists of a box with a number of coaxial and concentric pairs of tubes, the center of which contains elongated light bulbs. These pairs of coaxial and concentric tubes contain apertures over which displayed rings are placed. Frequently, this light shines into the eyes of a viewer and detracts from the beauty of the displayed article. This design also does not allow for easy removal of the rings for use or inspection by an individual. Furthermore, the use of alternating current electricity with this device limits its use to jewelers or collectors.

U.S. Pat. No. 3,937,320 by Chao et al. teaches a jewelry box of relatively normal design which illuminates displayed jewelry. A light bulb protrudes through a small opening in a display insert covering the underside of the jewelry box lid. The light bulb is powered by a battery hidden in the base section of the box. The included circuit is completed by a switch near the jewelry box hinge. When the lid of the jewelry box is opened, two U-shaped metal clips come into conductive contact with each other, thereby completing the electrical circuit necessary to illuminate the lamp. This idea also uses a remote lighting source that illuminates the entire jewelry box, and, consequently, the displayed article.

U.S. Pat. No. 5,329,433 by Geeting et al. is another patent that provides a jewelry box containing a lighting source in the top cover. When the cover is opened, a light shines from the cover of the jewelry box, illuminating the entire box, and, consequently, the displayed jewelry. Once again, this idea utilizes a remote lighting source that illuminates the entire bottom section of the jewelry box, and, consequently, the displayed article.

While these patents provide a variety of different active lighting schemes, they do not address problems inherent in lighting jewelry with a weak light source located far away from the displayed jewelry. First, the weak nature of the light source provides that there will only be minimal additional lighting provided under normal viewing conditions unless a high wattage lamp is used thereby shortening the battery lifetime. Second, by top lighting jewelry, shadows are created that tend to obscure many of the ornamental and desirable features intended to be displayed by the light box. Third, top lighting frequently places the light source in direct view of the observer, thus causing a glare that detracts from the beauty inherent in ornamental jewelry.

Another active jewelry enhancement feature is sound. Music emitting devices may also be incorporated into personal jewelry boxes to enhance the display potential. U.S. Pat. No. 4,882,966 by Silverman teaches a jewelry box containing an electronic music generating apparatus. In this patent, the music generating mechanism consists of a frequency generating device located in the bottom section and concealed by the display insert, and a speaker located behind the fabric liner of the top section. When the customer opens the lid of the box he or she hears pleasant music emanating from the display device.

None of the prior art provides for an increased intensity lighting source located in the bottom section near the jewelry, nor for the combination of light and sound to enhance the display of jewelry.

SUMMARY OF THE INVENTION

One object of the present invention is to provide for a jewelry display box that enhances the display of jewelry. This improved jewelry box enhances the display of jewelry by including a light source that supplements the ambient lighting. The jewelry illumination source of the present invention is in close proximity to the displayed jewelry. The close proximity of the light source allows for the use of a lower wattage light source to achieve equivalent illumination, thus providing a savings in battery lifetime.

While the prior art predominantly teaches jewelry illumination from above or behind, the present invention provides an illumination source located in the bottom section of the jewelry box, preferably in front of the jewelry. The illumination source is powered by a battery hidden from view by the display insert. Furthermore, the illumination source is activated by opening the jewelry box.

The present invention also provides for a combination of active enhancement elements, such as light and sound. The sound element may be provided by a music chip or generator, or the sound portion may be a sound recordable chip. The sound recordable chip would be useful for recording messages of endearment for replay upon the opening of the jewelry display box.

It is a further object of the present invention to provide a display box which in which fiber optics transmits light from a concealed source to the displayed item contained by the display box.

It is yet another object of the present invention to provide a jewelry display device which is capable of under lighting multiple pieces of jewelry simultaneously.

It is still yet another object of the present invention to provide a multi-piece jewelry display device which utilizes fiber optics to transmit light from a concealed source to the item to be illuminated.

BRIEF DESCRIPTION OF THE DRAWINGS

The above and still further objects, features and advantages of the present invention will become apparent upon consideration of the following detailed description of several specific embodiments thereof, especially when taken in conjunction with the accompanying drawings, wherein.

DESCRIPTION OF PREFERRED EMBODIMENTS

Figure 1:
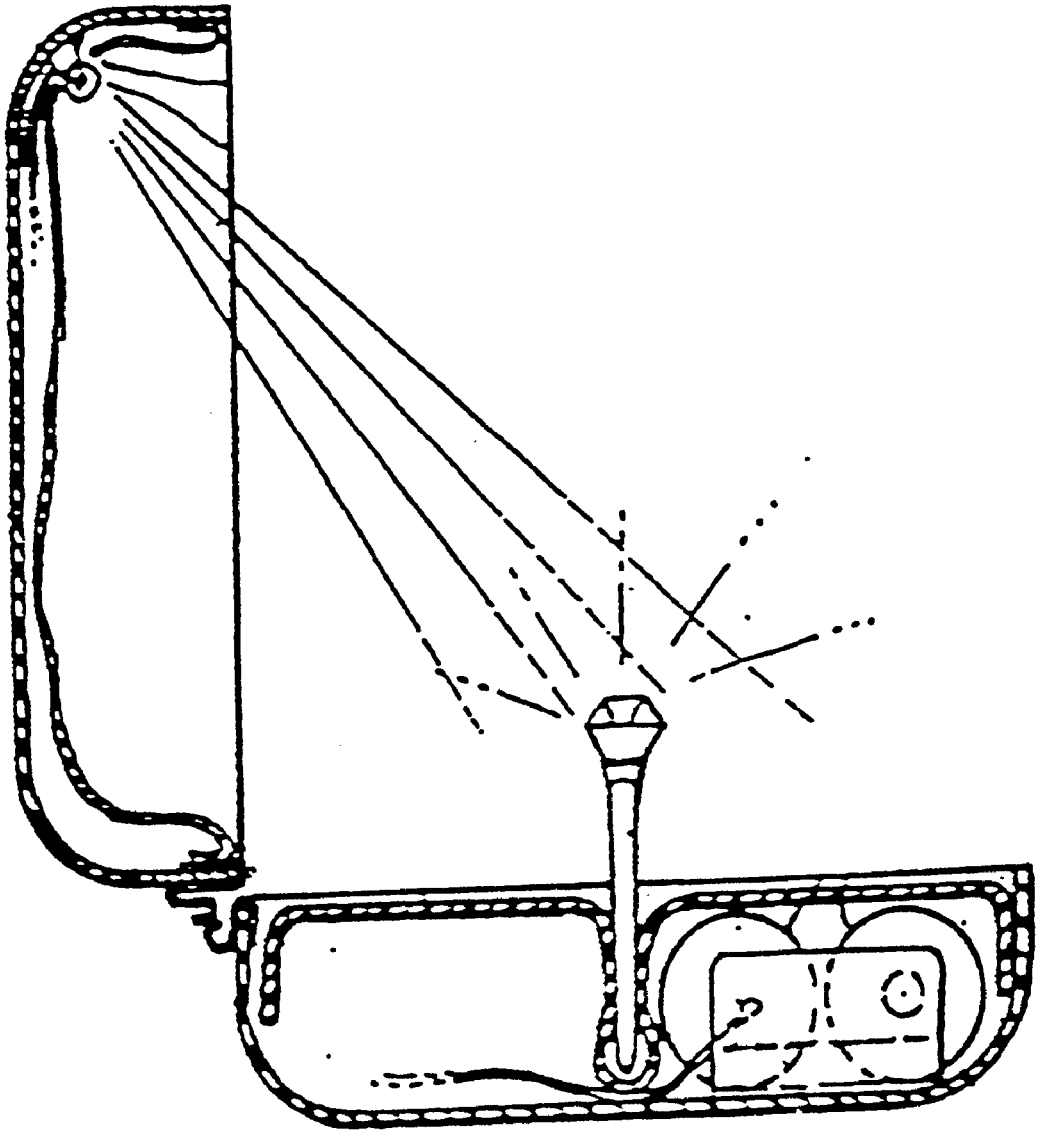
FIG. 1 is an example of a prior art jewelry display box with a downward directed illuminating lid lighting source.
Figure 2B:
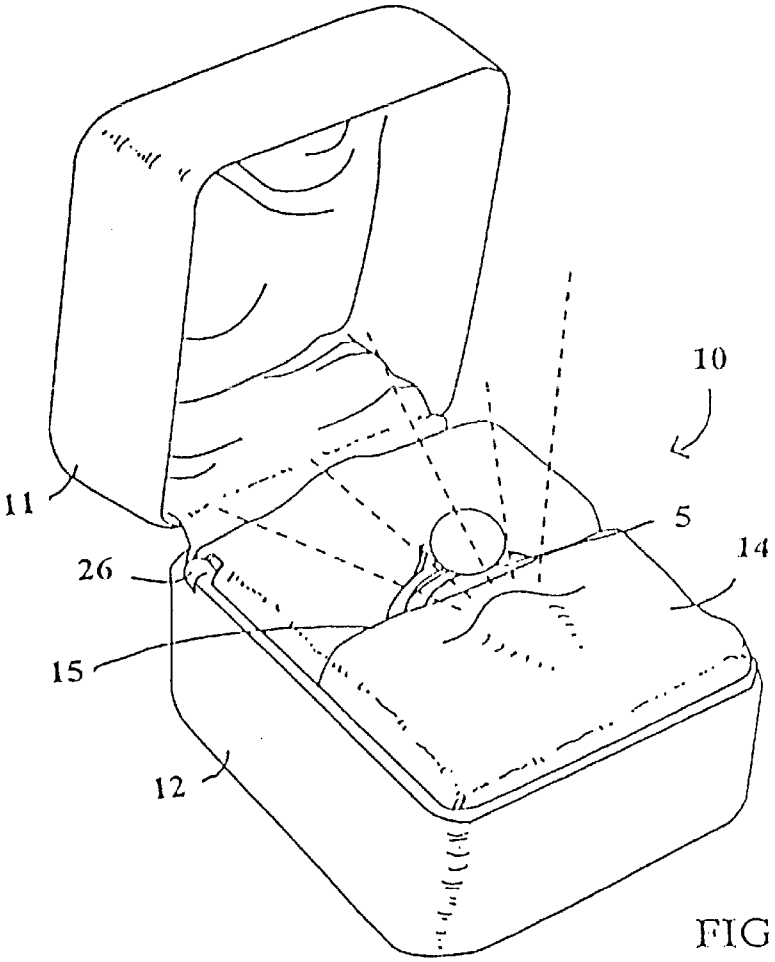
FIG. 2*b* illustrates the first embodiment of the present invention in an open configuration.
Figure 2A:
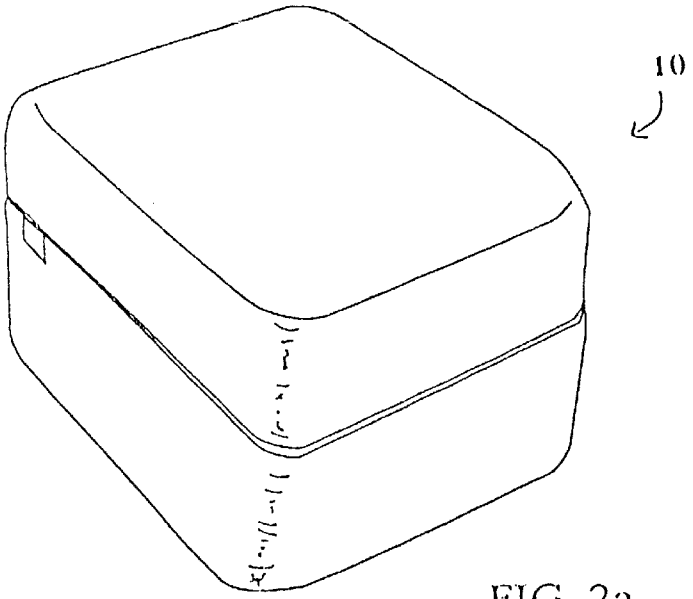
FIG. 2*a* illustrates a first embodiment of the present invention in a closed configuration.

Referring now to the drawings, FIG. 1 is a prior art example of a personal or single item jewelry display box which utilizes downwardly directed illumination. These, and like devices, provide additional lighting from a source located above and behind the displayed jewelry, thus only providing weak illumination that frequently shines directly on the viewer. The present invention is useful in that it directs illumination from below and in front of the displayed jewelry, thereby substantially increasing the light intensity falling on the jewelry and preventing unwanted direct illumination of the viewer. Furthermore, the present invention may include a sound source, such as a music chip or a voice recordable chip, to enhance the display capabilities of the display boxes.

The present invention is a jewelry box 10 with an electrical circuit 20 providing a switchable under lighting source 30 enhancing the display of contained jewelry 5.

The jewelry box 10 is constructed of a top section 11 pivotally connected to a bottom section 12 by a hinge 13. The jewelry box 10 is preferably covered with a fabric material, such as felt, which is pleasing to the touch. An inner surface of the top section 11 may be covered with a fabric like covering, such as silk, to further enhance the elegance of the jewelry box 10. The bottom section 12 contains a removable display insert 14, or faux bottom. The display insert 14 contains a jewelry holder 15 and an illumination aperture 16. When jewelry, such as a ring, is inserted into the jewelry holder 15 of the present invention, the jewelry 5 is displayed at an inclined angle. This allows a greater percentage of the illuminating rays to reflect from the surface of included jewels, making them brighter and more desirable.

In a first embodiment, the electrical circuit 20 comprises at least a power source 21, such as a battery, a light source 30, such as a light bulb connected to the battery, and a switch 22 connected to the power source 21 and the light source 30. The electrical circuit 20 is preferably hidden from view by the display insert 14.

The action of the switch 22 is coupled to opening the jewelry box 10 such that when the jewelry box 10 is opened, the electrical circuit 20 is completed, and the light source 30 is illuminated, thus under lighting the displayed piece of jewelry.

Figure 3:
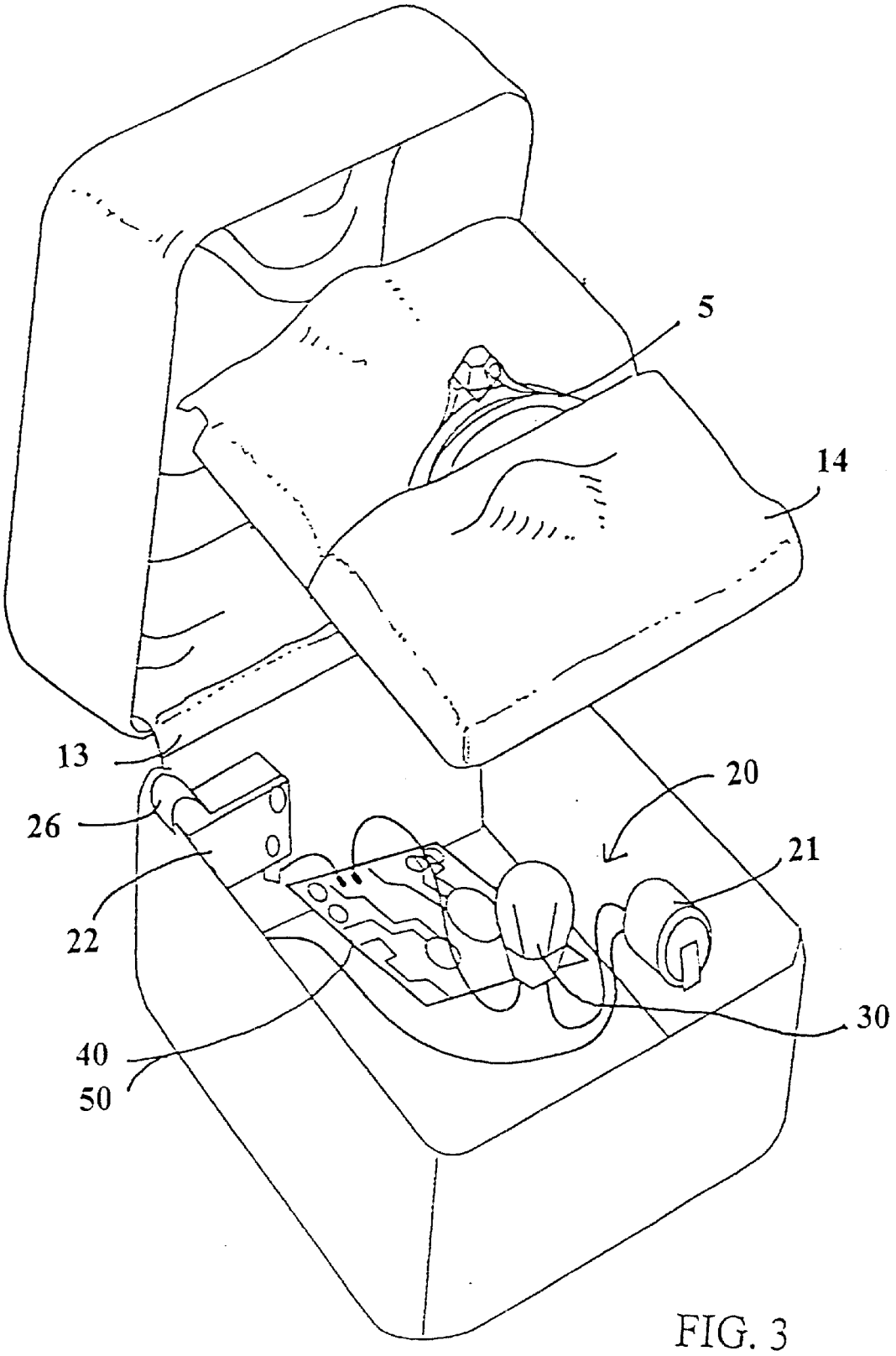
FIG. 3 is an exploded perspective view of the present invention illustrating an electrical circuit, such as one described in the third preferred embodiment, that may be used in the jewelry display box.
Figure 4B:
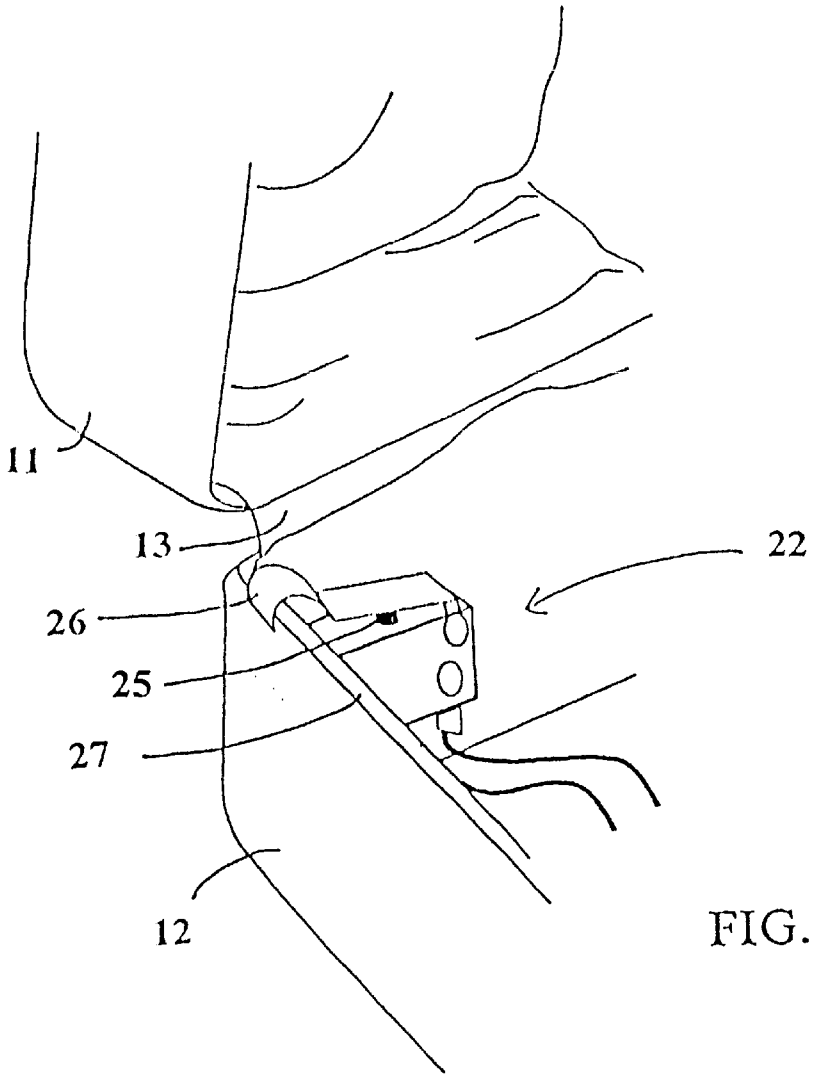
FIG. 4*b* is a detailed illustration of the hook and plunger switch when the first embodiment is in the open configuration.
Figure 4A:
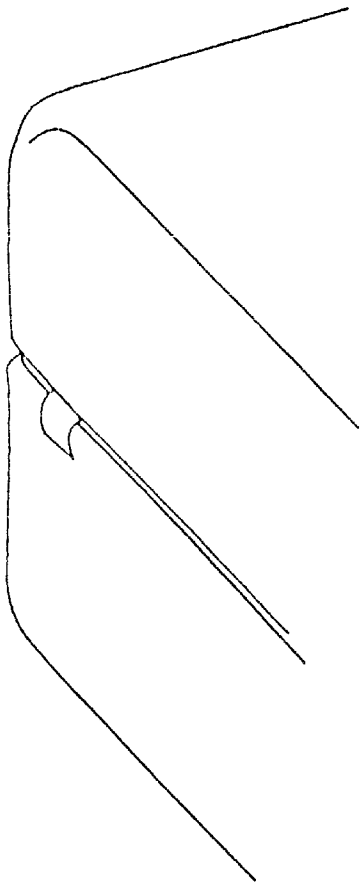
FIG. 4*a* is a detailed illustration of the placement and minimal exposure provided by a hook and plunger type switch as in the first embodiment when in the closed configuration.

In the first preferred embodiment, the switch 22 preferred is a spring biased switch with a plunger 25 and a lever 26 engaging the plunger 25. The lever 26 projects over a top edge 27 of the bottom section 12, preferably near the hinge 13. As the top section 11 of the jewelry box 10 is opened, the plunger 25 is allowed to move upward under the influence of the spring biasing thereby completing the circuit 20; thus energizing the light source 23, as illustrated in FIG. 3, FIGS. 4*a* and 4*b*.

Figure 5B:
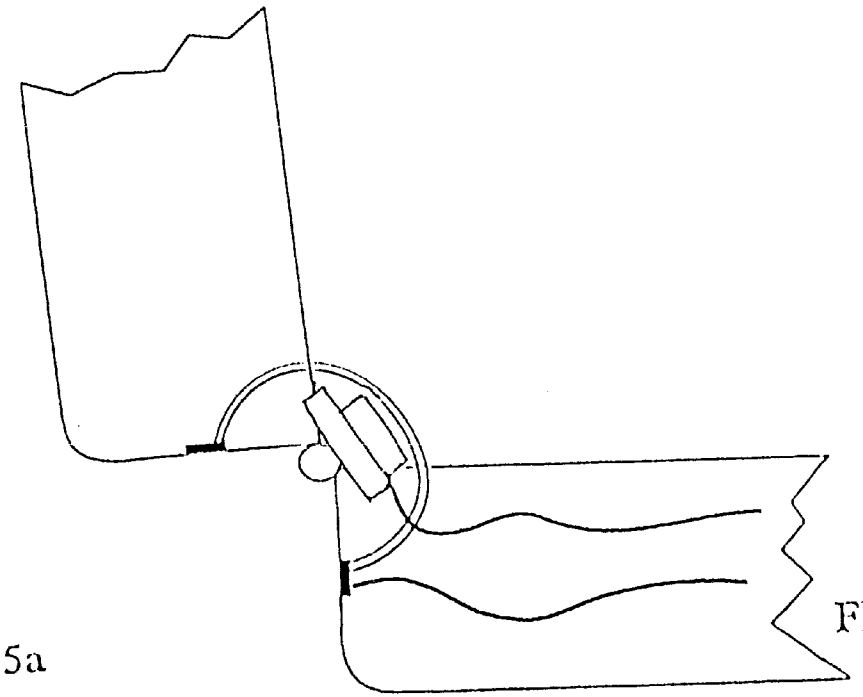
FIG. 5*b* illustrates an two contact hinge switch according to the second embodiment when the jewelry display box is in the open configuration.
Figure 5A:
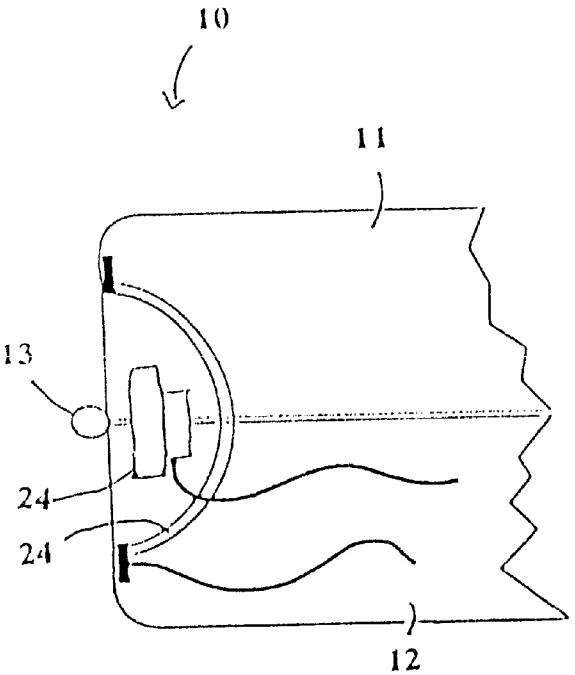
FIG. 5*a* illustrates an two contact hinge switch according to the second embodiment when the jewelry display box is in the closed configuration.

A second embodiment of the present invention utilizes a switch 22 that comprises a pair of contact surfaces 24 located near the hinge 13, shown in FIG. 5*a* and FIG. 5*b*. When the jewelry box 10 is in a closed configuration the pair of contact surfaces 24 are not in physical contact thereby preventing the flow of electricity, but upon opening the jewelry box 10, the pair of contact surfaces 24 come into contact, thereby completing the electrical circuit 20. It is contemplated that the hinge 13 may act as one of the pair of contract surfaces.

Figure 6C:
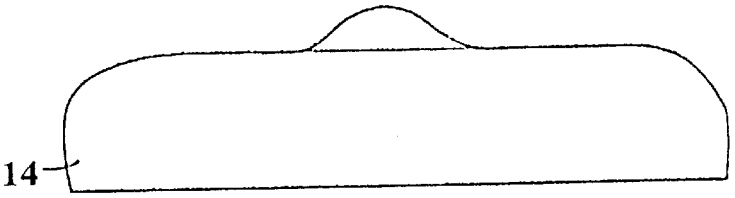
FIG. 6*c* shows a rear view of the display insert illustrating the placement of the light source of the present invention.
Figure 6B:
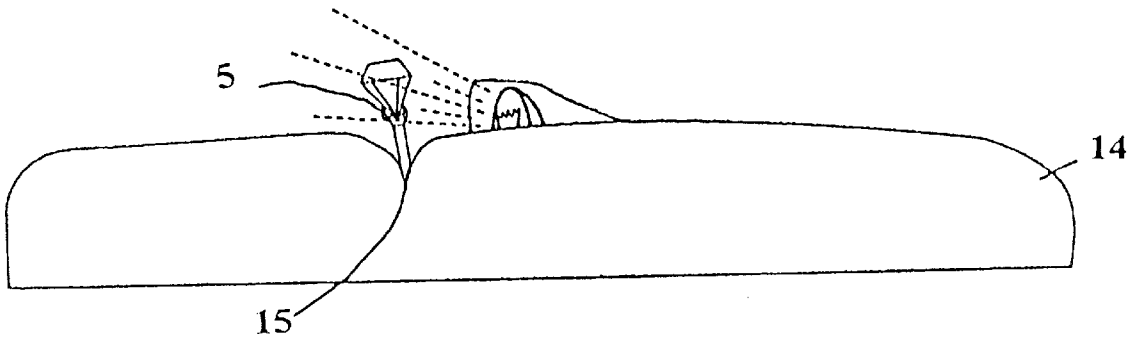
FIG. 6*b* depicts a side view of the display insert of the present invention, a portion of the display insert is cut way to provide a view of the light source.
Figure 6A:
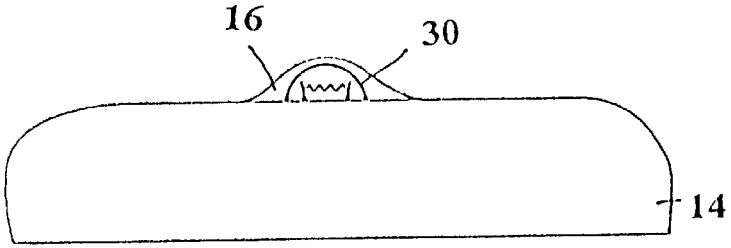
FIG. 6*a* shows a front view of the display insert the present invention.

The light source 30 of the present invention is a small light bulb, but may be any number of electrically powered light generating devices, and is positioned within the illumination aperture 16 in the display insert 14. The illumination aperture 16 is located near the jewelry holder 15 of the display insert 14 and directs radiated light toward the jewelry 5 contained within the jewelry box 10. Furthermore, it is preferable that the light source 30 is placed in a positioned where none of the illumination light is directed toward the viewer. This is illustrated in FIG. 6*a,* FIG. 6*b* and FIG. 6*c*. In the first and second embodiments, the illumination aperture 16 is located in front of the jewelry holder 15 or in a position opposite the jewelry holder 15 relative to the hinge 13. Thus the viewer sees the displayed piece of jewelry 5 via reflected light and without unwanted and unnecessary glare.

An alternate means to illuminate the displayed jewelry 5 is to conceal the light source 30 and, by coupling fiber optics between the light source 30 and the jewelry 5, illuminate the jewelry 5. The coupling of the fiber optics to the light source 30 may be via a focusing lens or merely placing one end of the fiber optics perpendicular to the light source 30.

In a third embodiment of the present invention, a music source 40 is placed in series within the electrical circuit 20. An example of this circuit is illustrated in FIG. 3. The music source 40 may be a preprogrammed integrated chip which inherently emits music, or it may be a separate, frequency generating electrical circuit coupled to a small speaker for sound generation. Thus, when the electrical circuit 20 is completed, the light source 30 illuminates the displayed jewelry and a pleasant musical tune is played.

A fourth embodiment of the present invention includes a sound recordable chip 50 placed in series within the electrical circuit 20 of the first, second or third embodiments. This circuit is may also be illustrated by FIG. 3. Thus, prior to presentation of the jewelry 5 as a gift, the gift giver may prerecord a personalized message on the sound recordable chip 50. This prerecorded message is then replayed when the jewelry box 10 is opened and the displayed piece of jewelry 5 illuminated.

Figure 7:
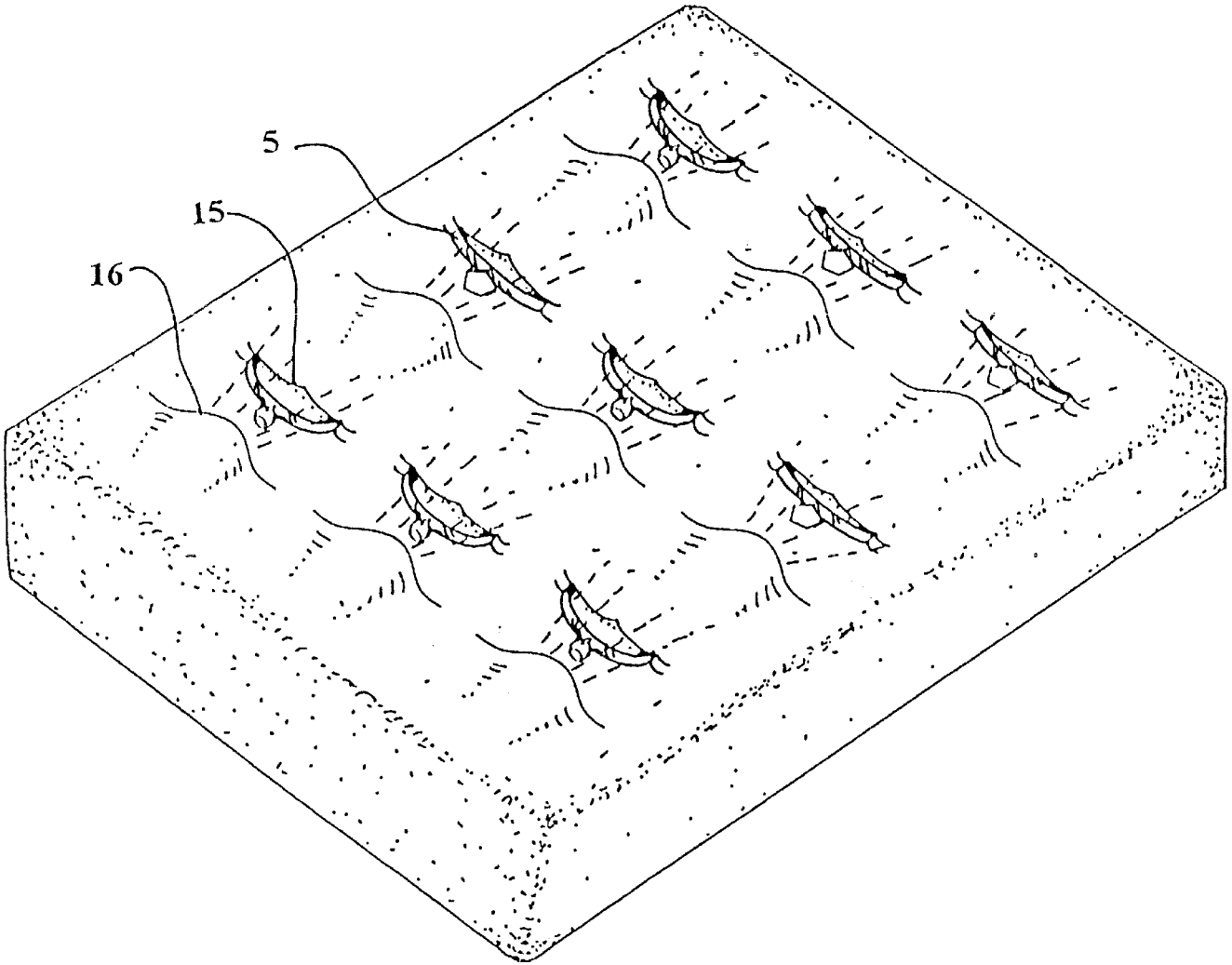
FIG. 7 illustrates a multi-piece display using the lighting concept of the present invention.
Figure 8:
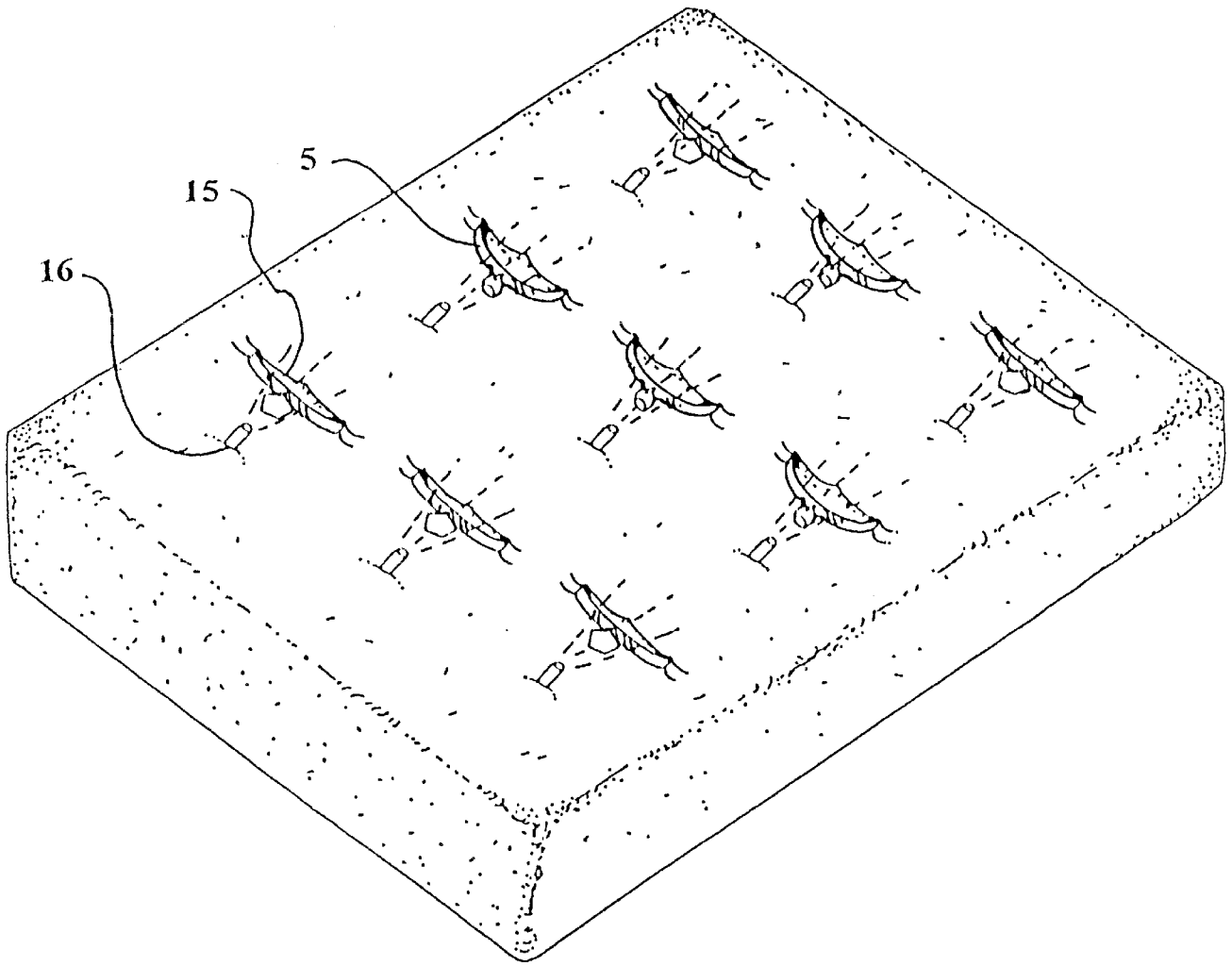
FIG. 8 illustrates a second form the multi-piece display using fiber optics in the illumination process.

A fifth embodiment of the present invention is a multi-piece jewelry display device. In this embodiment the jewelry box 10 is adapted to receive more than one piece of jewelry 5 by providing more than one a jewelry holder(s) 15 and accompanying illumination aperture(s) 16. See FIG. 7. As described above, there is an alternate means to illuminate the displayed jewelry 5 by concealing the light source 30 and, by coupling fiber optics between the light source 30 and the jewelry 5, thus illuminating the jewelry 5. See FIG. 8.

Thus, this is shown and described a unique and novel process, design and concept for the display of jewelry. While these descriptions are directed to particular embodiments, it is understood that those skilled in the art may conceive modifications and/or variations to the specific embodiments shown and described herein. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. An enhanced jewelry box comprising:

A) a top section pivotally connected to a bottom section by a hinge;

B) a display insert with an article holder and at least one illumination aperture, said at least one illumination aperture being located in the article holder and adapted to direct light upward toward an article held by the article holder; and C) an electrical circuit located underneath the display insert comprising:

i) a power source;

ii) a switch connected to the power source; and iii) an illumination source held in said at least one illumination aperture and connected to the switch and the power source;

wherein the electrical circuit is completed when the top section of the jewelry box is opened thereby energizing the illumination source.

2. A jewelry box as in claim 1 wherein the switch of the jewelry box further comprises a spring biased plunger switch with a lever that projects over an edge of the bottom section, and which completes the electrical circuit when the jewelry box is in an open configuration, but does not complete the electrical circuit when the jewelry box is in a closed configuration.

3. A jewelry box as in claim 2 wherein the electrical circuit further comprises a music source connected in series within the electrical circuit.

4. A jewelry box as in claim 2 wherein the electrical circuit further comprises a sound recordable source connected in series within the electrical circuit.

5. A jewelry box as in claim 2 wherein the electrical circuit firer comprises a sound recordable source and a music source, both connected in series within the electrical circuit.

6. A jewelry box as in claim 1 wherein the illumination source of the jewelry box further comprises a light bulb that is contained by the illumination aperture of the display insert.

7. A jewelry box as in claim 6 wherein the electrical circuit further comprises a music source connected in series within the electrical circuit.

8. A jewelry box as in claim 6 wherein the electrical circuit further comprises a sound recordable source connected in series within the electrical circuit.

9. A jewelry box as in claim 6 wherein the electrical circuit further comprises a sound recordable source and a music source, both connected in series within the electrical circuit.

10. A jewelry box as in claim 1 wherein the electrical circuit further comprises a music source connected in series within the electrical circuit.

11. A jewelry box as in claim 1 wherein the electrical circuit further comprises a sound recordable source connected in series within the electrical circuit.

12. A jewelry box as in claim 1 wherein the electrical circuit further comprises a sound recordable source and a music source, both connected in series within the electrical circuit.

13. A jewelry box as in claim 1 wherein the switch of the jewelry box further comprises the hinge connecting the top section to the bottom section and containing a pair of contacts which are in electrical connection when the jewelry box is in an open configuration, but is not in electrical connection when the jewelry box is in a closed configuration.

14. A jewelry box as in claim 13 wherein the electrical circuit further comprises a music source connected in series within, the electrical circuit.

15. A jewelry box as in claim 13 wherein the electrical circuit further comprises a sound recordable source connected in series within the electrical circuit.

16. A jewelry box as in claim 13 wherein the electrical circuit further comprises a sound recordable source and a music source, both connected in series within the electrical circuit.

17. An enhanced jewelry box comprising:

A) a top section pivotally connected to a bottom section by a hinge;

B) a display insert with an article holder and at least one illumination aperture, said at least one illumination aperture being located in the article holder and adapted to direct light upward, toward an article held by the article holder; and C) an electrical circuit located underneath the display insert comprising in series:

i) a power source;

ii) a switch;

iii) a music generating device; and iv) an illumination source held in said at least one illumination apertur;

wherein the electrical circuit is completed when the top section of the jewelry box is opened thereby energizing the illumination source and the music generating device.

18. The jewelry box of claim 17 wherein fiber optics are coupled to the illumination source, whereby light is transmitted from the illumination source, through the fiber optics, and out the at least one illumination aperture.

19. An enhanced jewelry box comprising:

A) a top section pivotally connected to a bottom section by a hinge and having an exterior fabric covering;

B) a display insert with an article holder and one illumination aperture, said one illumination aperture being located in the article holder and adapted to direct light upward, toward an article held by the article holder; and C) an electrical circuit located underneath the display insert comprising in series:

i) a power source securely fastened to the bottom section;

ii) a switch securely fastened to the bottom section;

iii) a music generating device securely fastened to the bottom section;

iv) a sound recordable chip securely fastened to the bottom section; and v) an illumination source held in the illumination aperture;

wherein the electrical circuit is completed when the top section of the jewelry box is opened thereby energizing the illumination source, the music generating device, and the sound recordable chip.

20. The jewelry box of claim 19 wherein fiber optics are coupled to the illumination source, whereby light is transmitted from the illumination source, through the fiber optics, and out the illumination aperture.

* * * * *